US007460993B2

(12) United States Patent
Chen et al.

(10) Patent No.: US 7,460,993 B2
(45) Date of Patent: Dec. 2, 2008

(54) ADAPTIVE WINDOW-SIZE SELECTION IN TRANSFORM CODING

(75) Inventors: Wei-Ge Chen, Issaquah, WA (US); Naveen Thumpudi, Sammamish, WA (US); Ming-Chieh Lee, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 1397 days.

(21) Appl. No.: 10/020,708

(22) Filed: Dec. 14, 2001

(65) Prior Publication Data

US 2003/0115052 A1 Jun. 19, 2003

(51) Int. Cl.
*G10L 19/00* (2006.01)

(52) U.S. Cl. ..... 704/230; 704/200.1

(58) Field of Classification Search ..... 704/229–230, 704/200.1

See application file for complete search history.

(56) References Cited

U.S. PATENT DOCUMENTS

| | | | | |
|---|---|---|---|---|
| 5,325,215 | A | 6/1994 | Shibata et al. | |
| 5,357,594 | A | 10/1994 | Fielder | |
| 5,379,351 | A | 1/1995 | Fandrianto et al. | |
| 5,394,473 | A * | 2/1995 | Davidson | 704/200.1 |
| 5,590,066 | A | 12/1996 | Ohki | |
| 5,686,964 | A | 11/1997 | Tabatabai et al. | |
| 5,845,243 | A | 12/1998 | Smart et al. | |
| 5,848,391 | A * | 12/1998 | Bosi et al. | 704/200.1 |
| 5,970,173 | A | 10/1999 | Lee et al. | |
| 5,995,151 | A | 11/1999 | Naveen et al. | |
| 5,995,539 | A | 11/1999 | Miller | |
| 6,029,126 | A | 2/2000 | Malvar | |
| 6,073,153 | A | 6/2000 | Malvar | |
| 6,115,689 | A | 9/2000 | Malvar | |
| 6,154,762 | A | 11/2000 | Malvar | |
| 6,167,093 | A * | 12/2000 | Tsutsui et al. | 375/242 |
| 6,301,304 | B1 | 10/2001 | Jing et al. | |
| 6,311,154 | B1 * | 10/2001 | Gersho et al. | 704/219 |
| 6,324,560 | B1 | 11/2001 | Malvar | |
| 6,363,117 | B1 | 3/2002 | Kok | |

(Continued)

FOREIGN PATENT DOCUMENTS

| | | |
|---|---|---|
| CA | 2452343 | 1/2003 |
| EP | 854653 | 7/1998 |
| JP | 2003-348598 | 12/2003 |

OTHER PUBLICATIONS

Gibson et al., *Digital Compression for Multimedia*, Title Page, Contents, "Chapter 7: Frequency Domain Coding," Morgan Kaufman Publishers, Inc., pp. iii, v-xi, and 227-262 (1998).

H.S. Malvar, *Signal Processing with Lapped Transforms*, Artech House, Norwood, MA, pp. iv, vii-xi, 175-218, and 353-357 (1992).

H.S. Malvar, "Lapped Transforms for Efficient Transform/Subband Coding," *IEEE Transactions on Acoustics on Acoustics, Speech and Signal Processing*, vol. 38, No. 6, pp. 969-978 (1990).

(Continued)

*Primary Examiner*—Angela A Armstrong
(74) *Attorney, Agent, or Firm*—Klarquist Sparkman, LLP

(57) ABSTRACT

A transform coder adaptively configures window sizes for transform coding in a two-pass process to maximize coding efficiency, while achieving necessary time resolution to avoid pre-echo. In a first pass, the coder places small size windows over detected transient regions of an input signal in an open-loop window configuration process. In a second pass, the coder adjusts the window size configuration according to measurements of the achieved quality in a closed-loop window configuration process. Where quality measurement shows unacceptable quantization noise, the coder increases window size. Where pre-echo is detected, the coder reduces window size within coding bit rate constraints.

40 Claims, 9 Drawing Sheets

U.S. PATENT DOCUMENTS

| | | | |
|---|---|---|---|
| 6,370,502 | B1 | 4/2002 | Wu et al. |
| 6,473,534 | B1 | 10/2002 | Merhav et al. |
| 6,487,574 | B1 | 11/2002 | Malvar |
| 6,496,795 | B1 | 12/2002 | Malvar |
| 6,507,614 | B1 | 1/2003 | Li |
| 6,687,726 | B1 | 2/2004 | Schneider |
| 6,694,342 | B1 | 2/2004 | Mou |
| 6,701,019 | B1 | 3/2004 | Wu et al. |
| 6,728,317 | B1 | 4/2004 | Demos |
| 6,882,685 | B2 | 4/2005 | Malvar |
| 2003/0115052 | A1 | 6/2003 | Chen et al. |
| 2005/0165611 | A1 | 7/2005 | Mehrotra et al. |

OTHER PUBLICATIONS

Seymour Schlien, "The Modulated Lapped Transform, Its Time-Varying Forms, and Its Application to Audio Coding Standards," *IEEE Transactions on Speech and Audio Processing*, vol. 5, No. 4, pp. 359-366 (Jul. 1997).

de Queiroz et al., "Time-Varying Lapped Transforms and Wavelet Packets," *IEEE Transactions on Signal Processing*, vol. 41, pp. 3293-3305 (1993).

Herley et al., "Tilings of the Time-Frequency Plane: Construction of Arbitrary Orthogonal Bases and Fast Tiling Algorithms," *IEEE Transactions on Signal Processing*, vol. 41, No. 12, pp. 3341-3359 (1993).

ISO/IEC 11172-3, Information Technology—Coding of Moving Pictures and Associated Audio for Digital Storage Media at Up to About 1.5 Mbit/s—Part 3: Audio, 154 pp. (1993).

Dolby Laboratories, "AAC Technology," 4 pp. [Downloaded from the web site aac-audio.com on World Wide Web on Nov. 21, 2001.].

Srinivasan et al., "High-Quality Audio Compression Using an Adaptive Wavelet Packet Decomposition and Psychoacoustic Modeling," *IEEE Transactions on Signal Processing*, vol. 46, No. 4, pp. 1085-1093 (Apr. 1998).

Caetano et al., "Rate Control Strategy for Embedded Wavelet Video Coders," *Electronics Letters*, pp. 1815-1817 (Oct. 14, 1999).

Ribas Corbera et al., "Rate Control in DCT Video Coding for Low-Delay Communications," *IEEE Transactions on Circuits and Systems for Video Technology*, vol. 9, No. 1, pp. 172-185 (Feb. 1999).

Zwicker et al., *Das Ohr als Nachrichtenempfänger*, Title Page, Table of Contents, "I: Schallschwingungen," Index, Hirzel-Verlag, Stuttgart, pp. III, IX-XI, 1-26, and 231-232 (1967).

Terhardt, "Calculating Virtual Pitch," *Hearing Research*, 1:155-182 (1979).

Lufti, "Additivity of Simultaneous Masking," *Journal of Acoustic Society of America*, 73:262-267 (1983).

Jesteadt et al., "Forward Masking as a Function of Frequency, Masker Level, and Signal Delay," *Journal of Acoustical Society of America*, 71:950-962 (1982).

ITU, Recommendation ITU-R BS 1387, Method for Objective Measurements of Perceived Audio Quality, 89 pp. (1998).

ITU, Recommendation ITU-R BS 1115, Low Bit-Rate Audio Coding, 9 pp. (1994).

Beerends, "Audio Quality Determination Based on Perceptual Measurement Techniques," *Applications of Digital Signal Processing to Audio and Acoustics*, Chapter 1, Ed. Mark Kahrs, Karlheinz Brandenburg, Kluwer Acad. Publ., pp. 1-38 (1998).

Zwicker, *Psychoakustik*, Title Page, Table of Contents, "Teil I: Einfuhrung," Index, Springer-Verlag, Berlin Heidelberg, New York, pp. II, IX-XI, 1-30, and 157-162 (1982).

Solari, *Digital Video and Audio Compression*, Title Page, Contents, "Chapter 8: Sound and Audio," McGraw-Hill, Inc., pp. iii, v-vi, and 187-211 (1997).

A.M. Kondoz, *Digital Speech: Coding for Low Bit Rate Communications Systems*, "Chapter 3.3: Linear Predictive Modeling of Speech Signals" and "Chapter 4: LPC Parameter Quantisation Using LSFs," John Wiley & Sons, pp. 42-53 and 79-97 (1994).

Kadatch, U.S. Appl. No. 09/771,371, entitled, "Quantization Loop with Heuristic Approach," filed Jan. 26, 2001.

Chen et al., U.S. Appl. No. 10/017,694, entitled, "Quality and Rate Control Strategy for Digital Audio," filed Dec. 14, 2001.

Chen et al., U.S. Appl. No. 10/017,702, entitled, "Quantization Matrices for Digital Audio," filed Dec. 14, 2001.

Chen et al., U.S. Appl. No. 10/017,861, entitled, "Techniques for Measurement of Perceptual Audio Quality," filed Dec. 14, 2001.

Chen et al., U.S. Appl. No. 10/016,918, entitled, "Quality Improvement Techniques in an Audio Encoder," filed Dec. 14, 2001.

Wragg et al., "An Optimised Software Solution for an ARM Powered™ MP3 Decoder," 9 pp. [Downloaded from the World Wide Web on Oct. 27, 2001.].

Fraunhofer-Gesellschaft, "MPEG Audio Layer-3," 4 pp. [Downloaded from the World Wide Web on Oct. 24, 2001.].

Fraunhofer-Gesellschaft, "MPEG-2 AAC," 3 pp. [Downloaded from the World Wide Web on Oct. 24, 2001.].

OPTICOM GmbH, "Objective Perceptual Measurement," 14 pp. [Downloaded from the World Wide Web on Oct. 24, 2001.].

De Luca, "AN1090 Application Note: STA013 MPEG 2.5 Layer III Source Decoder," STMicroelectronics, 17 pp. (1999).

Pharndo, "Speech Compression," 13 pp. [Downloaded from the World Wide Web on Nov. 25, 2001.].

Malvar, "Biorthogonal and Nonuniform Lapped Transforms for Transform Coding with Reduced Blocking and Ringing Artifacts," appeared in *IEEE Transactions on Signal Processing, Special Issue on Multirate Systems, Fiter Banks, Wavelets, and Applications*, vol. 46, 29 pp. (1998).

Advanced Television Systems Committee, "ATSC Standard: Digital Audio Compression (AC-3), Revision A," pp. 1-140 (Aug. 2001).

Arai, et al., "A Fast DCT-SQ Scheme for Images," The Transactions of the IEICE, vol. E 71, No. 11, Nov. 1988, pp. 1095-1097.

Bjontegaard, "H.26L Test Model Long Term No. 8 (TML-8) Draft 0," *Video Coding Experts Group (VCEG)*, pp. 1-46.

Brandenburg, "ASPEC Coding", *AES 10th International Conference*, pp. 81-90 (1991).

Calderbank et al., "Wavelet Transforms that Map Integers to Intergers," pp. 1-39 (Aug. 1996).

Cham, "Development of Integer Cosine Transforms by the Principle of Dyadic Symmetry," *IEE Proceedings*, vol. 136, Pt. 1, No. 4, pp. 276-282 (Aug. 1989).

W. Chen, C. H. Smith, and S. C. Fralick, "A fast computational algorithm for the discrete cosine transform," *IEEE Trans. Commun.*, vol. 25, pp. 1004-1009, Sep. 1977.

J. W. Cooley and J. W. Tukey, "An algorithm for the machine calculation of complex Fourier series," *Math. Computation*, vol. 19, pp. 297-301, 1965.

R. Cox, "The design of uniformly and nonuniformly spaced pseudoquadrature mirror filters" *IEEE Transactions on Acoustics, Speech, and Signal Processing*, vol. 34, pp. 1090-1096, Oct. 1986.

ISO/IEC 13818-7, "Information Technology-Generic Coding of Moving Pictures and Associated Audio Information," Part 7: Advanced Audio Coding (AAC), pp. i-iv, 1-148 (1997).

ISO/IEC 13818-7, Technical Corrigendum 1, "Information Technology-Generic Coding of Moving Pictures and Associated Audio Information," Part 7: Advanced Audio Coding (AAC), Technical Corrigendum, pp. 1-22 (1997).

Li et al., "On Implementing Transforms from Integers to Integers," *Department of Electrical Engineering, Princeton University*, pp. 881-885, Jun. 1998.

Liang et al., "A 16-bit Architecture for H.26L, Treating DCT Transforms and Quantization," *Thirteenth Meeting*: Austin, Texas, USA, pp. 1-20 (Apr. 2001).

Liang et al., "Fast Multiplierless Approximation of the DCT with the Lifting Scheme," *Proc. SPIE Apps. of Digital Image Processing XXIII*, 12 pp. (Aug. 2000).

C. Loeffler et al., "Practical fast 1-D DCT algorithms with 11 multiplications," *Proc. IEEE ICASSP*, vol. 2, pp. 988-991, Feb. 1989.

H. S. Malvar, "Biorthogonal and nonuniform lapped transforms for transform coding with reduced blocking and ringing artifacts", *IEEE Transactions on Signal Processing*, vol. 46, pp. 1043-1053, Apr. 1998.

H. S. Malvar, "Enhancing the performance of subband audio coders for speech signal", *Proc. 1998 IEEE International Symposium on Circuits and Systems*, vol. 5, pp. 98-101, Jun. 1998.

H. Malvar, "Fast computation of the discrete cosine transform and the discrete Hartley transform," *IEEE Trans. Acoust. Speech, Signal Processing*, vol. ASSP-35, pp. 1484-1485, Oct. 1987.
O. A. Niamut and R. Heusdens, "Subband merging in cosine-modulated filter banks", IEEE Signal Processing Letters, vol. 10, pp. 111-114, Apr. 2003.
Rubino et al., "Improved Chen-Smith Image Coder," 1993 IEEE International Symposium on Circuits and Systems, ISCAS 1993, pp. 267-270, 1993.

* cited by examiner

Figure 1, Prior Art
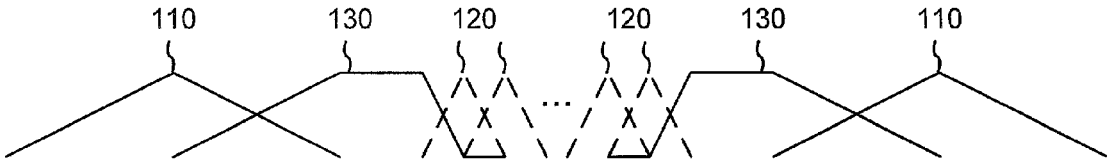
Figure 2
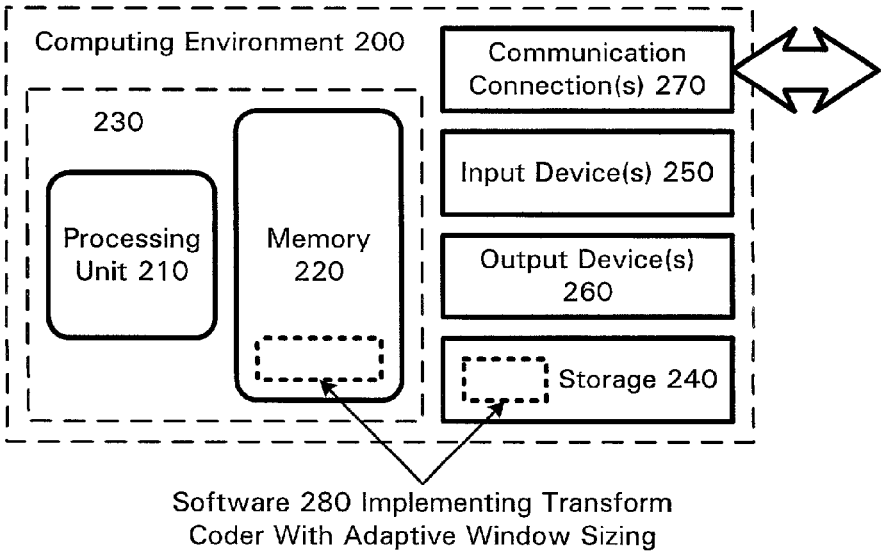

Start
9
900
Bit Rate Setting?
910
Coding Efficiency
920
Measure Quality Of Coding Windows in Frame
930
Noise Ratio >Threshold?
yes
no
940
Buffer Near Full?
yes
950
Increase Minimum Allowed Window Size In Frame
no
10

Start
9
900
Bit Rate Setting?
910
Coding Efficiency
Measure Quality Of Coding Windows in Previous Frame(s)
920
Noise Ratio >Threshold?
930
yes
no
Buffer Near Full?
940
yes
no
950
Increase Minimum Allowed Window Size In Frame
10

ADAPTIVE WINDOW-SIZE SELECTION IN TRANSFORM CODING

RELATED APPLICATION INFORMATION

The following concurrently-filed, U.S. patent applications relate to the present application: U.S. patent application Ser. No. 10/017,694, entitled, "QUALITY AND RATE CONTROL STRATEGY FOR DIGITAL AUDIO," filed Dec. 14, 2001, the disclosure of which is hereby incorporated by reference; U.S. patent application Ser. No. 10/017,861, entitled, "TECHNIQUES FOR MEASUREMENT OF PERCEPTUAL AUDIO QUALITY," filed Dec. 14, 2001, the disclosure of which is hereby incorporated by reference [hereafter "Perceptual Audio Quality Measurement Patent Application"]; U.S. patent application Ser. No. 10/017,702, entitled, "QUANTIZATION MATRICES FOR DIGITAL AUDIO," filed Dec. 14, 2001, the disclosure of which is hereby incorporated by reference; and U.S. patent application Ser. No. 10/016,918, entitled, "QUALITY IMPROVEMENT TECHNIQUES IN AN AUDIO ENCODER," filed Dec. 14, 2001, the disclosure of which is hereby incorporated by reference.

TECHNICAL FIELD

The present invention relates to techniques for digitally encoding audio and other signals. The invention more particularly relates to improvements in coding efficiency of transform coding.

BACKGROUND

Transform coding is a compression technique used in many audio compression systems. Uncompressed digital audio is typically represented as a stream of amplitude samples of an audio signal taken at regular time intervals. For example, a typical format for audio on compact disks consists of a stream of sixteen-bit samples per channel of the audio (e.g., the original analog audio signal from a microphone) captured at a rate of 44.1 KHz. Each sample is a sixteen-bit number representing the amplitude of the audio signal at the time of capture. Other digital audio systems may use various different amplitude and time resolutions of audio sampling.

Uncompressed digital audio can consume considerable storage and transmission capacity. Transform coding reduces the size of digital audio by transforming the time-domain representation of the audio into a frequency-domain (or other like transform domain) representation, and then reducing resolution of certain generally less perceptible frequency components of the frequency-domain representation. This generally produces much less perceptible degradation of the audio signal compared to reducing amplitude or time resolution of audio in the time domain.

More specifically, a typical transform coding technique divides the uncompressed digital audio's stream of time-samples into fixed-size subsets or blocks, each block possibly overlapping with other blocks. A linear transform that does time-frequency analysis is applied to each block, which converts the time interval audio samples within the block to a set of frequency (or transform) coefficients generally representing the strength of the audio signal in corresponding frequency bands over the block interval. For compression, the transform coefficients may be selectively quantized (i.e., reduced in resolution, such as by dropping least significant bits of the coefficient values or otherwise mapping values in a higher resolution number set to a lower resolution), and also entropy or variable-length coded into a compressed audio data stream. At decoding, the transform coefficients will inversely transform to nearly reconstruct the original amplitude/time sampled audio signal.

Many audio compression systems, such as MPEG2 Advanced Audio Coding (AAC) and Windows Media Audio (WMA), utilize the Modulated Lapped Transform (MLT, also known as Modified Discrete Cosine Transform or MDCT) to perform the time-frequency analysis in audio transform coding. MLT reduces blocking artifacts introduced into the reconstructed audio signal by quantization. More particularly, when non-overlapping blocks are independently transform coded, quantization errors will produce discontinuities in the signal at the block boundaries upon reconstruction of the audio signal at the decoder. For audio, a periodic clicking effect is heard.

The MLT reduces the blocking effect by overlapping blocks. In the MLT, a "window" of 2M samples from two consecutive blocks undergoes a cosine transform. Only the first M transform coefficients are returned. The window is then shifted by M samples and the next set of M transform coefficients is computed. Thus, each window overlaps the last M samples of the previous window. The overlap enhances the continuity of the reconstructed samples despite the alterations of transform coefficients due to quantization.

Some audio compression systems vary the size of window over time to accommodate the changing nature of the audio. Audio coders typically partition the input audio signal into fixed-sized "frames," each of which is a unit of coding (e.g., coding tables and/or parameters may be sent in a header section of each frame). In audio compression systems using time-varying MLT, each frame may contain one or more "windows" of variable size, where each window is a unit of the MLT. In general, larger windows are beneficial to coding efficiency, whereas smaller size windows provide better time resolution. Accordingly, the decisions of where and what windows sizes to employ are critical to compression performance and auditory quality of the encoded signal. The topic of time-varying MLT is discussed, inter alia, by Seymour Shlien, "The Modulated Lapped Transform, Its Time-Varying Forms, And Its Application To Audio Coding Standards," *IEEE Trans. of Speech and Audio Processing*, Vol. 5, No. 4, pp. 359-366 (July 1997); Ricardo L. de Queiroz and K. R. Rao, "Time-Varying Lapped Transforms And Wavelet Packets," *IEEE Trans. Signal Processing*, vol. 41, pp 3293-3305, 1993; and Cormac Herley, Jelena Kovacevic and Martin Vetterli, "Tilings Of The Time-Frequency Plane: Construction Of Arbitrary Orthogonal Bases And Fast Tiling Algorithms," *IEEE Trans. Signal Processing*, vol. 41, pp. 3341-3359, 1993.

One problem in audio coding is commonly referred to as "pre-echo." Pre-echo occurs when the audio undergoes a sudden change (referred to as a "transient"). In transform coding, particular frequency coefficients commonly are quantized (i.e., reduced in resolution). When the transform coefficients are later inverse-transformed to reproduce the audio signal, this quantization introduces quantization noise that is spread over the entire block in the time domain. This inherently causes rather uniform smearing of noise within the coding frame. The noise, which generally is tolerable for some part of the frame, can be audible and disastrous to auditory quality during portions of the frame where the masking level is low. In practice, this effect shows up most prominently when a signal has a sharp attack immediately following a region of low energy, hence the term "pre-echo." "Post-echo" that occurs when the signal transition from high to low energy is less of a problem to perceptible auditory quality due to a property of the human auditory system.

One example of an audio compression system that uses a time-varying MLT is MPEG AAC. In MPEG MC, two window sizes of the MLT transform are allowed, long and short. As shown in FIG. 1, the encoder selects between long window and short window modes for each frame. During the switch between modes, a transition window is used. (In FIG. 1, the boundary filter shapes of these transform windows are simplified for illustration purposes only, and not accurate.) In other words, for a particular frame, the encoder encodes the transform coefficients of the MLT transform of one long window, or of eight short windows of identical size. A transition window is used when switching between modes. The mode with small size windows can be chosen to increase time-resolution of the MLT during transients in the audio input.

SUMMARY

Embodiments of a transform coder are described herein that more effectively address problems of pre-echo, with improved quality and coding efficiency. With one transform coder embodiment described herein, almost arbitrary transform window sizes are permitted, so that smaller window sizes are placed more exactly at transient locations. Intermediate size transform windows are placed to fill out frames with such small windows at the transient locations. This maximizes coding efficiency while achieving necessary time resolution to avoid pre-echo effects.

One transform coder embodiment described herein uses a two-pass technique for allocating transform window sizes. This transform encoder includes modules for a transient detector, window configuration, encoder and quality measurement. The transient detector analyzes the input signal to detect transient regions. In a first pass, the window configuration module places small windows over transient regions identified by the transient detector, such that any transients are covered by one or more such small windows. Gaps occurring before and after these small windows in the frame are filled with one or more intermediate size "transition" windows. Large windows are used in frames without transients.

The encoder may perform a time-frequency analysis transform (e.g., the MLT), rate control, quantization, and their inverse processes. This produces an encoded and then reproduced first-pass signal for analysis by the quality measurement module.

For a second pass, the quality measurement module measures an achieved quality for each coding window, and feeds the results back to the window configuration module. Based on the quality measurement, the window configuration adjusts the size of windows based upon the quality measurement feedback to meet a desired coding bit-rate objective. For example, windows whose quality measurement shows unacceptably high quantization noise may be increased in size (e.g., combined with adjacent windows) depending on the desired bit-rate setting and rate control buffer fullness.

The quality measurement may further include detection of pre-echo. The window configuration module may then further reduce the size of windows where pre-echo is detected (e.g., further sub-dividing the intermediate size transition windows), provided the rate control buffer is sufficiently empty for the desired bit-rate setting.

After re-configuration of window sizes in the second pass, the encoder module produces a second-pass encoded representation of the signal.

This transform coder embodiment has the advantage that the first-pass yields a good choice of window-size configuration most of the time (e.g., about 90%). The second pass provides a benefit of further improving pre-echo avoidance, and also providing a mechanism for graceful quality degradation for a given bit-rate setting.

Additional features and advantages of the invention will be made apparent from the following detailed description of an illustrative embodiment that proceeds with reference to the accompanying drawings.

BRIEF DESCRIPTION OF THE DRAWINGS

FIG. 1 is a graph of an example configuration of windows in a prior art transform coder.

FIG. 2 is a block diagram of a suitable computing environment in which the transform coder of FIG. 5 may be incorporated.

DETAILED DESCRIPTION

Figure 3:
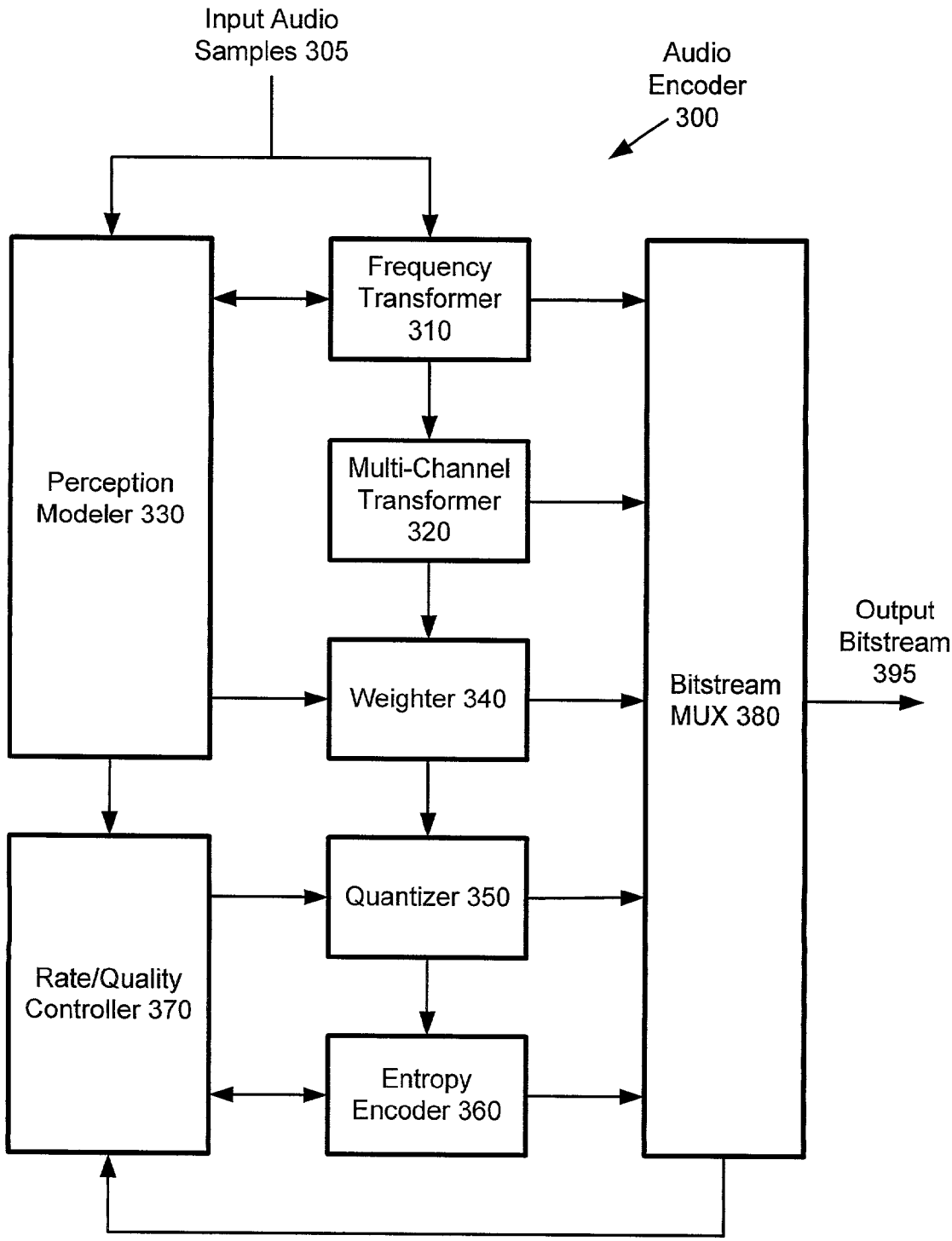
FIGS. 3 and 4 are a block diagram of an audio encoder and decoder in which the transform coder of FIG. 5 may be incorporated.

The following detailed description addresses embodiments of a transform coder with adaptive window-size selection in accordance with the invention. The coder selects sizes of windows for transform coding so as to allow an arbitrary combination of one or more window sizes within a frame. The coder configures an arbitrary combination of one or more window sizes in a frame using a two-pass process (a first open loop configuration pass, and second closed-loop configuration pass) to maximize coding efficiency while achieving necessary time resolution to avoid pre-echo from signal transients, all within bit rate constraints.

I. Computing Environment

FIG. 2 illustrates a generalized example of a suitable computing environment (200) in which the illustrative embodiment may be implemented. The computing environment (200) is not intended to suggest any limitation as to scope of use or functionality of the invention, as the present invention may be implemented in diverse general-purpose or special-purpose computing environments.

With reference to FIG. 2, the computing environment (200) includes at least one processing unit (210) and memory (220). In FIG. 2, this most basic configuration (230) is included within a dashed line. The processing unit (210) executes computer-executable instructions and may be a real or a virtual processor. In a multi-processing system, multiple processing units execute computer-executable instructions to increase processing power. The memory (220) may be volatile memory (e.g., registers, cache, RAM), non-volatile memory (e.g., ROM, EEPROM, flash memory, etc.), or some combination of the two. The memory (220) stores software (280) implementing an audio encoder.

A computing environment may have additional features. For example, the computing environment (200) includes storage (240), one or more input devices (250), one or more output devices (260), and one or more communication connections (270). An interconnection mechanism (not shown) such as a bus, controller, or network interconnects the components of the computing environment (200). Typically, operating system software (not shown) provides an operating environment for other software executing in the computing environment (200), and coordinates activities of the components of the computing environment (200).

The storage (240) may be removable or non-removable, and includes magnetic disks, magnetic tapes or cassettes, CD-ROMs, CD-RWs, DVDs, or any other medium which can be used to store information and which can be accessed within the computing environment (200). The storage (240) stores instructions for the software (280) implementing the audio encoder.

The input device(s) (250) may be a touch input device such as a keyboard, mouse, pen, or trackball, a voice input device, a scanning device, or another device that provides input to the computing environment (200). For audio, the input device(s) (250) may be a sound card or similar device that accepts audio input in analog or digital form. The output device(s) (260) may be a display, printer, speaker, or another device that provides output from the computing environment (200).

The communication connection(s) (270) enable communication over a communication medium to another computing entity. The communication medium conveys information such as computer-executable instructions, compressed audio or video information, or other data By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (200), computer-readable media include memory (220), storage (240), and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "get," "adjust," and "apply" to describe computer operations in a computing environment. These terms are high-level abstractions for operations performed by a computer, and should not be confused with acts performed by a human being. The actual computer operations corresponding to these terms vary depending on implementation.

II. Generalized Audio Encoder and Decoder

FIG. 3 is a block diagram of a generalized audio encoder (300). The relationships shown between modules within the encoder and decoder indicate the main flow of information in the encoder and decoder; other relationships are not shown for the sake of simplicity. Depending on implementation and the type of compression desired, modules of the encoder or decoder can be added, omitted, split into multiple modules, combined with other modules, and/or replaced with like modules. In alternative embodiments, encoders or decoders with different modules and/or other configurations of modules measure perceptual audio quality.

A. Generalized Audio Encoder

The generalized audio encoder (300) includes a frequency transformer (310), a multi-channel transformer (320), a perception modeler (330), a weighter (340), a quantizer (350), an entropy encoder (360), a rate/quality controller (370), and a bitstream multiplexer ["MUX"] (380).

The encoder (300) receives a time series of input audio samples (305) in a format such as one shown in Table 1. For input with multiple channels (e.g., stereo mode), the encoder (300) processes channels independently, and can work with jointly coded channels following the multi-channel transformer (320). The encoder (300) compresses the audio samples (305) and multiplexes information produced by the various modules of the encoder (300) to output a bitstream (395) in a format such as Windows Media Audio ["WMA"] or Advanced Streaming Format ["ASF"]. Alternatively, the encoder (300) works with other input and/or output formats.

The frequency transformer (310) receives the audio samples (305) and converts them into data in the frequency domain. The frequency transformer (310) splits the audio samples (305) into blocks, which can have variable size to allow variable temporal resolution. Small blocks allow for greater preservation of time detail at short but active transition segments in the input audio samples (305), but sacrifice some frequency resolution. In contrast, large blocks have better frequency resolution and worse time resolution, and usually allow for greater compression efficiency at longer and less active segments. Blocks can overlap to reduce perceptible discontinuities between blocks that could otherwise be introduced by later quantization. The frequency transformer (310) outputs blocks of frequency coefficient data to the multi-channel transformer (320) and outputs side information such as block sizes to the MUX (380). The frequency transformer (310) outputs both the frequency coefficient data and the side information to the perception modeler (330).

The frequency transformer (310) partitions a frame of audio input samples (305) into overlapping sub-frame blocks with time-varying size and applies a time-varying MLT to the sub-frame blocks. Possible sub-frame sizes include 128, 256, 512, 1024, 2048, and 4096 samples. The MLT operates like a DCT modulated by a time window function, where the window function is time varying and depends on the sequence of sub-frame sizes. The MLT transforms a given overlapping block of samples $x[n], 0 \leqq n < subframe_size$ into a block of frequency coefficients $X[k], 0 \leqq k < subframe_size/2$. The frequency transformer (310) can also output estimates of the complexity of future frames to the rate/quality controller (370). Alternative embodiments use other varieties of MLT. In still other alternative embodiments, the frequency transformer (310) applies a DCT, FFT, or other type of modulated or non-modulated, overlapped or non-overlapped frequency transform, or use subband or wavelet coding.

For multi-channel audio data, the multiple channels of frequency coefficient data produced by the frequency transformer (310) often correlate. To exploit this correlation, the multi-channel transformer (320) can convert the multiple original, independently coded channels into jointly coded channels. For example, if the input is stereo mode, the multi-channel transformer (320) can convert the left and right channels into sum and difference channels:

$$X_{Sum}[k] = \frac{X_{Left}[k] + X_{Right}[k]}{2} \quad (1)$$

$$X_{Diff}[k] = \frac{X_{Left}[k] - X_{Right}[k]}{2} \quad (2)$$

Or, the multi-channel transformer (320) can pass the left and right channels through as independently coded channels. More generally, for a number of input channels greater than one, the multi-channel transformer (320) passes original, independently coded channels through unchanged or converts the original channels into jointly coded channels. The decision to use independently or jointly coded channels can be predetermined, or the decision can be made adaptively on a block by block or other basis during encoding. The multi-channel transformer (320) produces side information to the MUX (380) indicating the channel mode used.

The perception modeler (330) models properties of the human auditory system to improve the quality of the reconstructed audio signal for a given bitrate. The perception modeler (330) computes the excitation pattern of a variable-size block of frequency coefficients. First, the perception modeler (330) normalizes the size and amplitude scale of the block. This enables subsequent temporal smearing and establishes a consistent scale for quality measures. Optionally, the perception modeler (330) attenuates the coefficients at certain frequencies to model the outer/middle ear transfer function. The perception modeler (330) computes the energy of the coefficients in the block and aggregates the energies by 25 critical bands. Alternatively, the perception modeler (330) uses another number of critical bands (e.g., 55 or 109). The frequency ranges for the critical bands are implementation-dependent, and numerous options are well known. For example, see ITU-R BS 1387 or a reference mentioned therein. The perception modeler (330) processes the band energies to account for simultaneous and temporal masking. In alternative embodiments, the perception modeler (330) processes the audio data according to a different auditory model, such as one described or mentioned in ITU-R BS 1387.

The weighter (340) generates weighting factors (alternatively called a quantization matrix) based upon the excitation pattern received from the perception modeler (330) and applies the weighting factors to the data received from the multi-channel transformer (320). The weighting factors include a weight for each of multiple quantization bands in the audio data. The quantization bands can be the same or different in number or position from the critical bands used elsewhere in the encoder (300). The weighting factors indicate proportions at which noise is spread across the quantization bands, with the goal of minimizing the audibility of the noise by putting more noise in bands where it is less audible, and vice versa. The weighting factors can vary in amplitudes and number of quantization bands from block to block. In one implementation, the number of quantization bands varies according to block size; smaller blocks have fewer quantization bands than larger blocks. For example, blocks with 128 coefficients have 13 quantization bands, blocks with 256 coefficients have 15 quantization bands, up to 25 quantization bands for blocks with 2048 coefficients. The weighter (340) generates a set of weighting factors for each channel of multi-channel audio data in independently coded channels, or generates a single set of weighting factors for jointly coded channels. In alternative embodiments, the weighter (340) generates the weighting factors from information other than or in addition to excitation patterns.

The weighter (340) outputs weighted blocks of coefficient data to the quantizer (350) and outputs side information such as the set of weighting factors to the MUX (380). The weighter (340) can also output the weighting factors to the rate/quality controller (340) or other modules in the encoder (300). The set of weighting factors can be compressed for more efficient representation. If the weighting factors are lossy compressed, the reconstructed weighting factors are typically used to weight the blocks of coefficient data. If audio information in a band of a block is completely eliminated for some reason (e.g., noise substitution or band truncation), the encoder (300) may be able to further improve the compression of the quantization matrix for the block.

The quantizer (350) quantizes the output of the weighter (340), producing quantized coefficient data to the entropy encoder (360) and side information including quantization step size to the MUX (380). Quantization introduces irreversible loss of information, but also allows the encoder (300) to regulate the bitrate of the output bitstream (395) in conjunction with the rate/quality controller (370). In FIG. 3, the quantizer (350) is an adaptive, uniform scalar quantizer. The quantizer (350) applies the same quantization step size to each frequency coefficient, but the quantization step size itself can change from one iteration to the next to affect the bitrate of the entropy encoder (360) output. In alternative embodiments, the quantizer is a non-uniform quantizer, a vector quantizer, and/or a non-adaptive quantizer.

The entropy encoder (360) losslessly compresses quantized coefficient data received from the quantizer (350). For example, the entropy encoder (360) uses multi-level run length coding, variable-to-variable length coding, run length coding, Huffman coding, dictionary coding, arithmetic coding, LZ coding, a combination of the above, or some other entropy encoding technique.

The rate/quality controller (370) works with the quantizer (350) to regulate the bitrate and quality of the output of the encoder (300). The rate/quality controller (370) receives information from other modules of the encoder (300). In one implementation, the rate/quality controller (370) receives estimates of future complexity from the frequency transformer (310), sampling rate, block size information, the excitation pattern of original audio data from the perception modeler (330), weighting factors from the weighter (340), a block of quantized audio information in some form (e.g., quantized, reconstructed, or encoded), and buffer status information from the MUX (380). The rate/quality controller (370) can include an inverse quantizer, an inverse weighter, an inverse multi-channel transformer, and, potentially, an entropy decoder and other modules, to reconstruct the audio data from a quantized form.

The rate/quality controller (370) processes the information to determine a desired quantization step size given current conditions and outputs the quantization step size to the quantizer (350). The rate/quality controller (370) then measures the quality of a block of reconstructed audio data as quantized with the quantization step size, as described below. Using the measured quality as well as bitrate information, the rate/quality controller (370) adjusts the quantization step size with the goal of satisfying bitrate and quality constraints, both instantaneous and long-term. In alternative embodiments, the rate/quality controller (370) applies works with different or additional information, or applies different techniques to regulate quality and bitrate.

In conjunction with the rate/quality controller (370), the encoder (300) can apply noise substitution, band truncation, and/or multi-channel rematrixing to a block of audio data. At low and mid-bitrates, the audio encoder (300) can use noise substitution to convey information in certain bands. In band truncation, if the measured quality for a block indicates poor quality, the encoder (300) can completely eliminate the coefficients in certain (usually higher frequency) bands to improve the overall quality in the remaining bands. In multi-channel rematrixing, for low bitrate, multi-channel audio data in jointly coded channels, the encoder (300) can suppress information in certain channels (e.g., the difference channel) to improve the quality of the remaining channel(s) (e.g., the sum channel).

The MUX (380) multiplexes the side information received from the other modules of the audio encoder (300) along with the entropy encoded data received from the entropy encoder (360). The MUX (380) outputs the information in WMA or in another format that an audio decoder recognizes.

The MUX (380) includes a virtual buffer that stores the bitstream (395) to be output by the encoder (300). The virtual buffer stores a pre-determined duration of audio information (e.g., 5 seconds for streaming audio) in order to smooth over short-term fluctuations in bitrate due to complexity changes in the audio. The virtual buffer then outputs data at a relatively constant bitrate. The current fullness of the buffer, the rate of change of fullness of the buffer, and other characteristics of the buffer can be used by the rate/quality controller (370) to regulate quality and bitrate.

B. Generalized Audio Decoder

Figure 4:
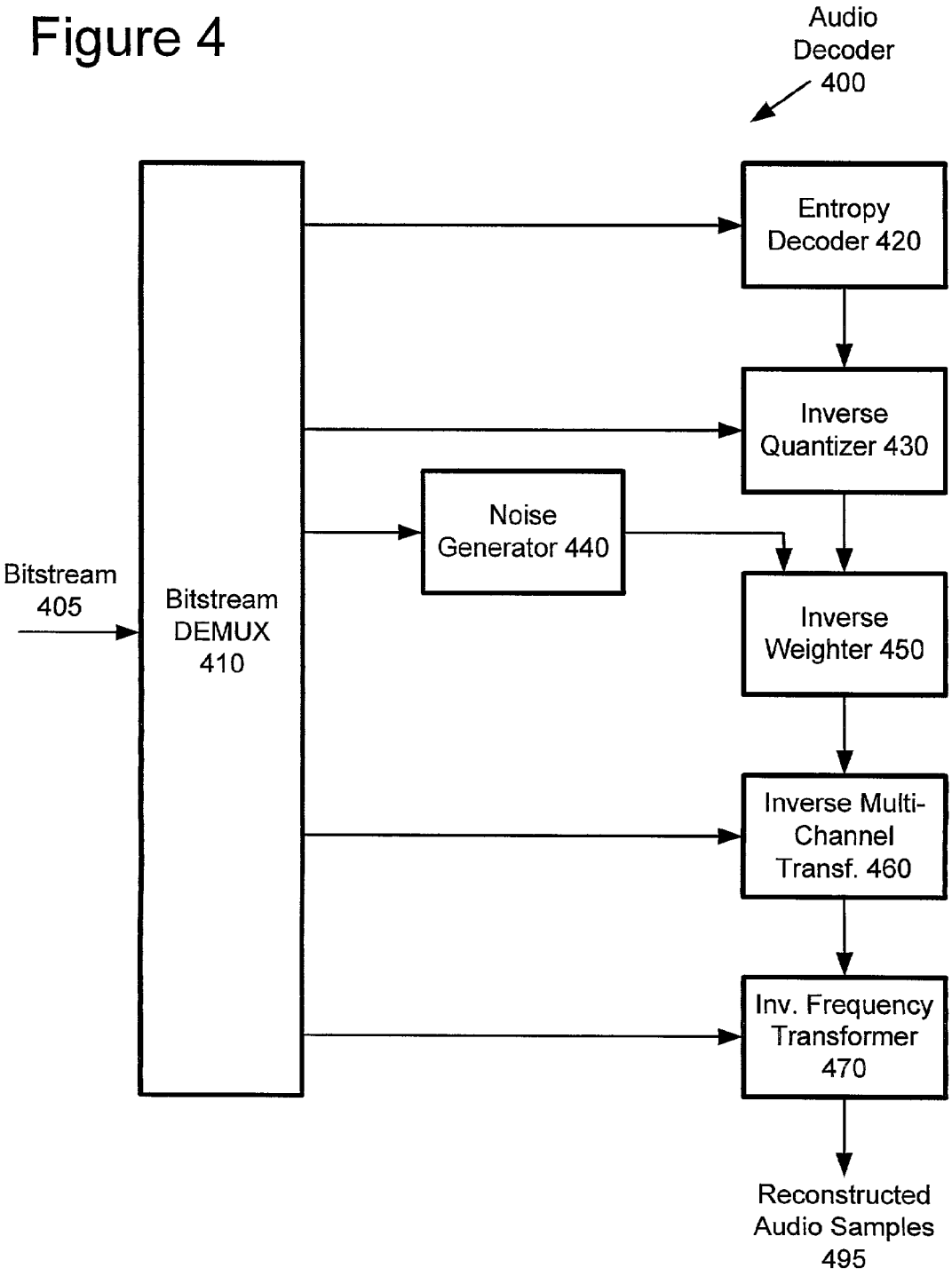

With reference to FIG. 4, the generalized audio decoder (400) includes a bitstream demultiplexer ["DEMUX"] (410), an entropy decoder (420), an inverse quantizer (430), a noise generator (440), an inverse weighter (450), an inverse multi-channel transformer (460), and an inverse frequency transformer (470). The decoder (400) is simpler than the encoder (300) is because the decoder (400) does not include modules for rate/quality control.

The decoder (400) receives a bitstream (405) of compressed audio data in WMA or another format. The bitstream (405) includes entropy encoded data as well as side information from which the decoder (400) reconstructs audio samples (495). For audio data with multiple channels, the decoder (400) processes each channel independently, and can work with jointly coded channels before the inverse multi-channel transformer (460).

The DEMUX (410) parses information in the bitstream (405) and sends information to the modules of the decoder (400). The DEMUX (410) includes one or more buffers to compensate for short-term variations in bitrate due to fluctuations in complexity of the audio, network jitter, and/or other factors.

The entropy decoder (420) losslessly decompresses entropy codes received from the DEMUX (410), producing quantized frequency coefficient data. The entropy decoder (420) typically applies the inverse of the entropy encoding technique used in the encoder.

The inverse quantizer (430) receives a quantization step size from the DEMUX (410) and receives quantized frequency coefficient data from the entropy decoder (420). The inverse quantizer (430) applies the quantization step size to the quantized frequency coefficient data to partially reconstruct the frequency coefficient data. In alternative embodiments, the inverse quantizer applies the inverse of some other quantization technique used in the encoder.

The noise generator (440) receives from the DEMUX (410) indication of which bands in a block of data are noise substituted as well as any parameters for the form of the noise. The noise generator (440) generates the patterns for the indicated bands, and passes the information to the inverse weighter (450).

The inverse weighter (450) receives the weighting factors from the DEMUX (410), patterns for any noise-substituted bands from the noise generator (440), and the partially reconstructed frequency coefficient data from the inverse quantizer (430). As necessary, the inverse weighter (450) decompresses the weighting factors. The inverse weighter (450) applies the weighting factors to the partially reconstructed frequency coefficient data for bands that have not been noise substituted. The inverse weighter (450) then adds in the noise patterns received from the noise generator (440).

The inverse multi-channel transformer (460) receives the reconstructed frequency coefficient data from the inverse weighter (450) and channel mode information from the DEMUX (410). If multi-channel data is in independently coded channels, the inverse multi-channel transformer (460) passes the channels through. If multi-channel data is in jointly coded channels, the inverse multi-channel transformer (460) converts the data into independently coded channels. If desired, the decoder (400) can measure the quality of the reconstructed frequency coefficient data at this point.

The inverse frequency transformer (470) receives the frequency coefficient data output by the multi-channel transformer (460) as well as side information such as block sizes from the DEMUX (410). The inverse frequency transformer (470) applies the inverse of the frequency transform used in the encoder and outputs blocks of reconstructed audio samples (495).

III. Adaptive Window-Size Transform Coder

Figure 5:
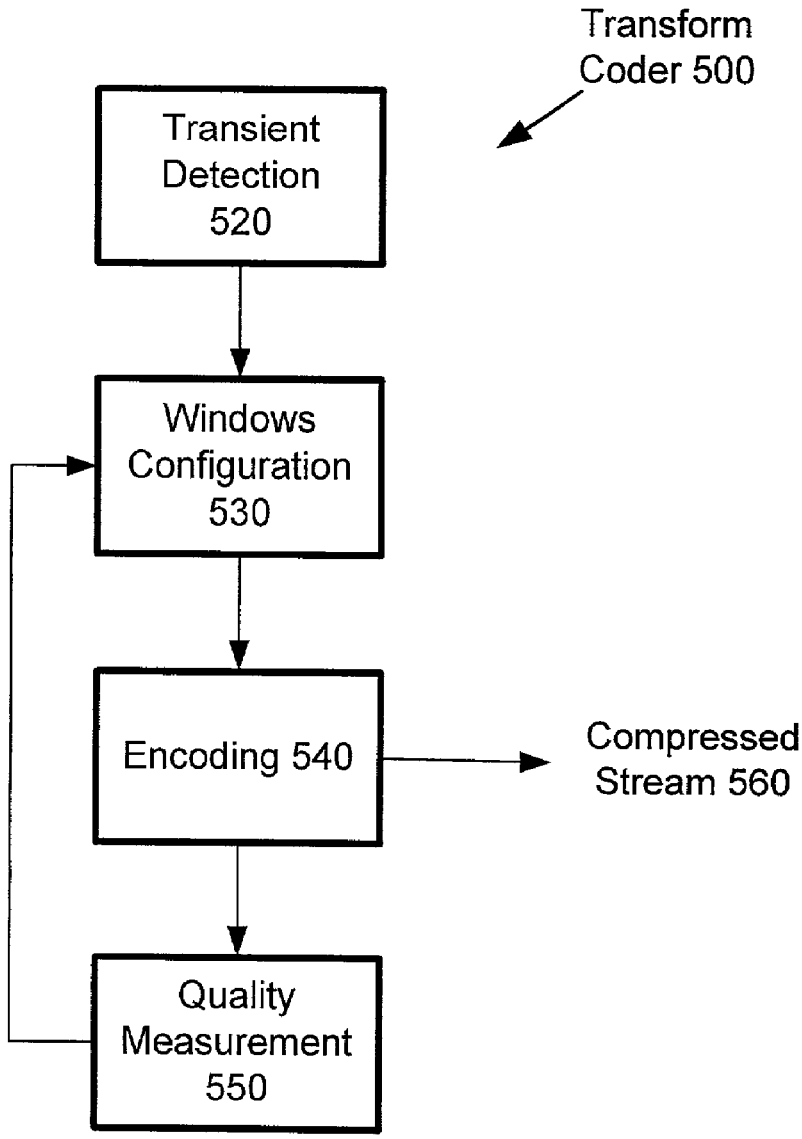
FIG. 5 is a block diagram of a transform coder with adaptive window-size selection according to an embodiment of the invention.

FIG. 5 shows a transform coder 500 with adaptive window-size selection according to the invention. The transform coder 500 can be realized within the generalized audio encoder 300 described above. The transform coder 500 alternatively can be realized in audio encoders that include fewer or additional encoding processes than the described, generalized audio encoder 300. Also, the transform coder 500 can be realized in encoders of signals other than audio.

The transform coder 500 utilizes a two-pass process to select window sizes for transform coding. In a first, open-loop pass, the transform coder detects transients in the input signal, and initially configures window sizes for transform coding. For this initial window-size configuration, the transform coder places one or more small windows over transient regions, places large windows in frames without transients, and fills gaps between the large window frames and the small windows with one or more intermediate-size windows. In a second, closed-loop pass, the transform coder first transform codes and then reconstructs the signal using the initial window configuration, so that it can then analyze auditory quality of transform coding using the initial window configuration. Based on the quality measurement, the transform coder adjusts window sizes, either combining to form larger windows to improve coding efficiency to achieve a desired bitrate, or dividing to form smaller windows to avoid pre-echo. To save on computation, the transform coder 500 can use the quality measured on the previous frame to make adjustments to the window configuration of the current frame, thereby merging the functionality of the two passes, without having to re-code.

Figure 6:
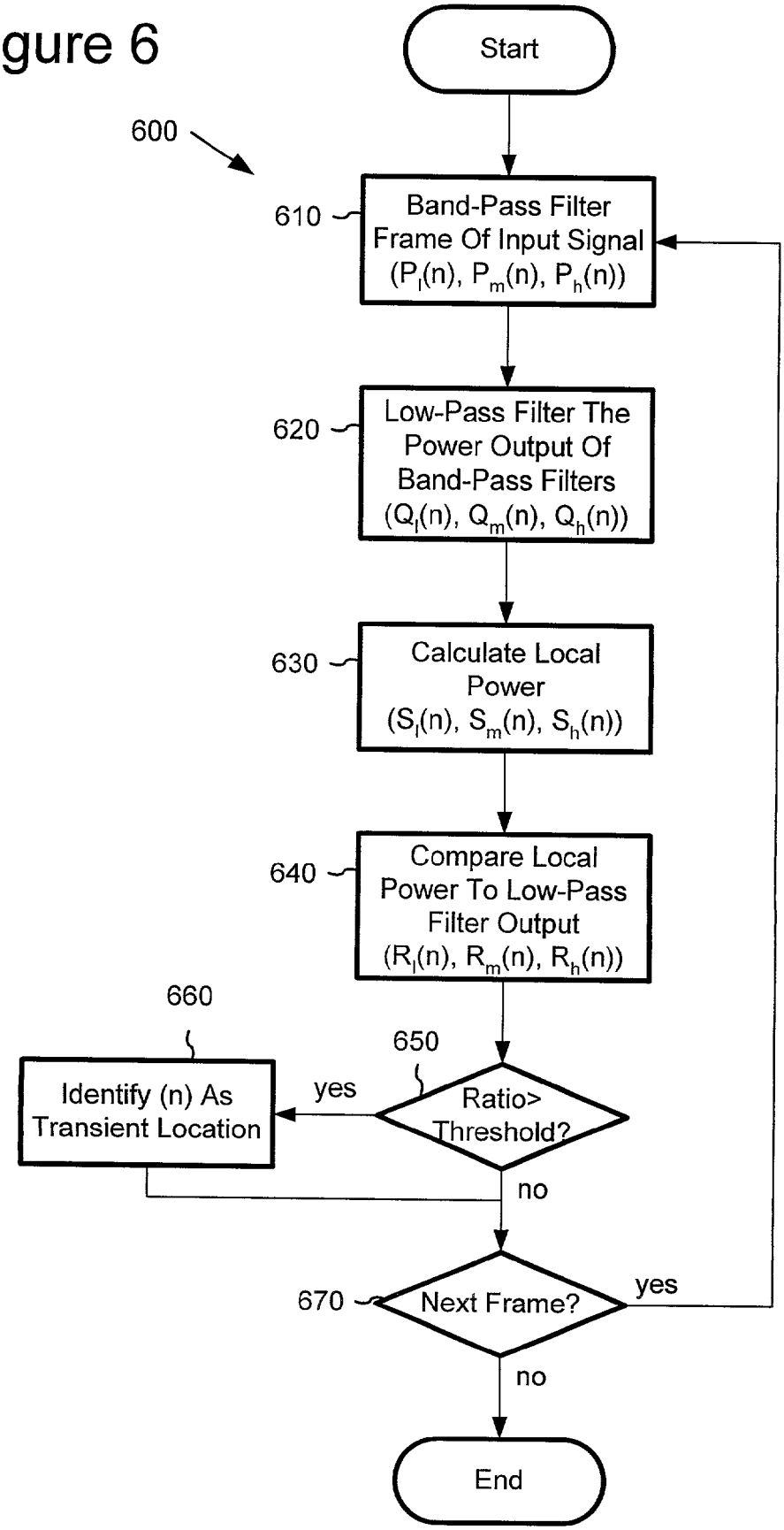
FIG. 6 is a flow chart of a transient detection process in the transform coder of FIG. 5.

With reference more particularly to FIG. 5, the transform coder 500 comprises components for transient detection 520, windows configuration 530, encoding 540, and quality measurement 550. The transient detection component 520 detects regions of the input signal that exhibit characteristics of a transient, and identifies such regions to the window configuration component 530. The transient detection component 520 can use various conventional techniques to detect transient regions in the input signal. An exemplary transient detection process 600 is illustrated in FIG. 6, and described below.

Figure 8:
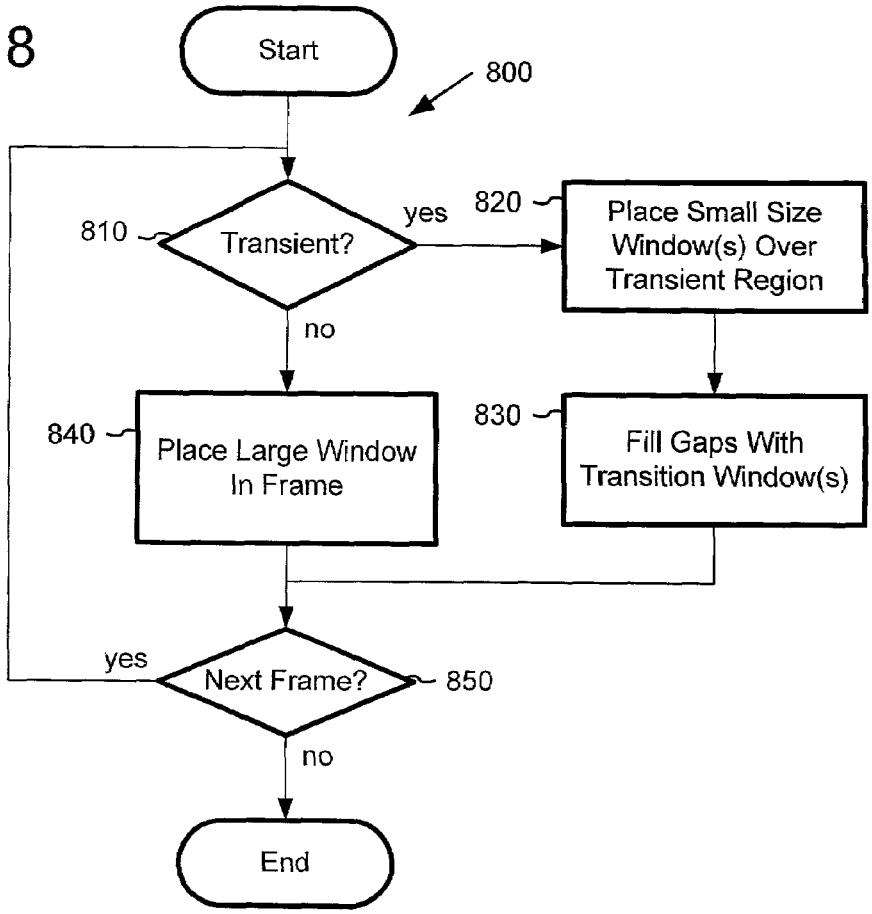
FIG. 8 is a flow chart of an open-loop, first-pass window size configuration process in the transform coder of FIG. 5.
Figure 9:
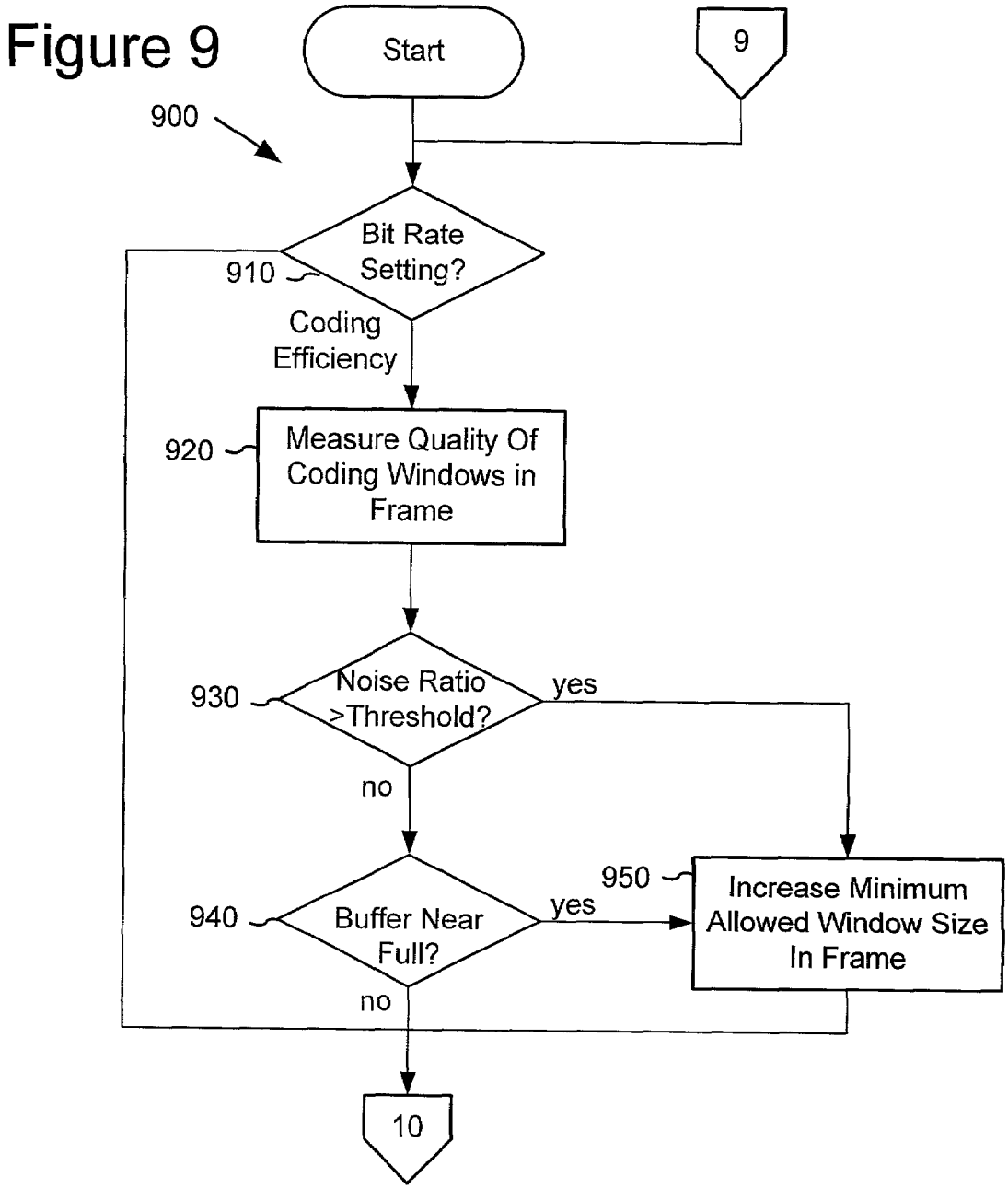
FIGS. 9 and 10 are a flow chart of a closed-loop, second-pass window size configuration process in the transform coder of FIG. 5.

The windows configuration component 530 configures windows sizes for transform coding. An initial configuration is determined on an open-loop basis based on the transient locations identified by the transient detector component 520. An exemplary open-loop windows configuration process 800 is illustrated in FIG. 8, and described below. The windows configuration component 530 thereafter adjusts the initial window sizes from the initial configuration based on closed-loop feedback from the quality measurement component 550, to produce a final configuration. An exemplary closed-loop windows configuration process 900 is illustrated in FIG. 9, and described below.

The encoding component 540 implements processes for transform coding, rate control, quantization and their inverse processes, and may encompass the various components that implement these processes in the generalized audio encoder 300 and decoder 400 described above. The encoding component 540 initially transform codes (with rate control and quantization) the input signal using the first pass window size configuration produced by the window configuration component 530, which the encoding component 540 then decodes to provide a reconstructed signal for auditory quality analysis by the quality measurement component 550. The encoding component 540 again transform codes (with rate-control and quantization) the input signal using the second-pass window size configuration provided by the window configuration component 530 to produce the compressed stream 560.

The quality measurement component 550 analyzes the auditory quality of the reconstructed signal produced from transform coding using the first-pass window size configuration, so as to provide closed-loop quality measurement feedback to the windows configuration component 530. The quality measurement component analyzes the quality of each coding window, such as by measuring the noise-to-excitation ratio achieved for the coding window. Alternatively, various other quality measures (e.g., the noise-to-mask ratio) can be used to assess the quality achieved with the selected window size. This quality measure is used by the windows configuration component 530 in its second-pass to select particular window sizes to increase for rate control, with minimal loss of quality.

Figure 10:
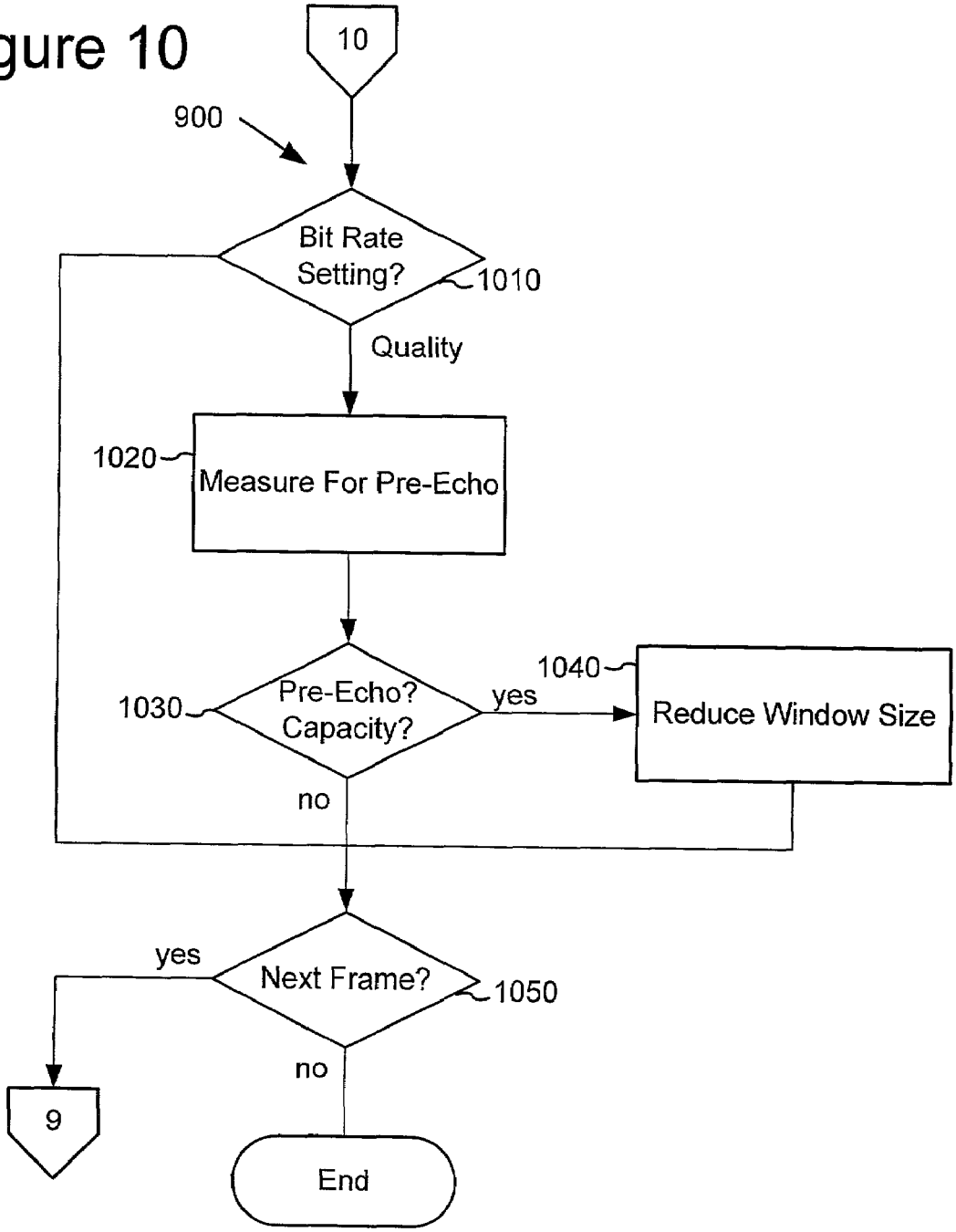

The quality measurement component 550 also uses the quality analysis to detect pre-echo. An exemplary process to detect pre-echo is illustrated in FIG. 10, and described below. Results of the pre-echo detection also are fed back to the window configuration component 530. Based on the pre-echo detection feedback, the window configuration component 530 may further reduce window sizes (e.g., where rate-control constraints allow) to avoid pre-echo for the second-pass window configuration.

In the case of multi-channel audio encoding, the transform coder 500 in one implementation produces a common window size configuration for the multiple coding channels. In an alternative implementation for multi-channel audio encoding, the transform coder 500 separately configures transform window sizes for individual coding channels.

A. Transient Detection

FIG. 6 illustrates one exemplary transient detection process 600 performed by the transient detection component 520 to detect transients in the input signal. As indicated at step 670, the process 670 is repeated on a frame-by-frame basis on the input signal.

The transient detection process 600 first band-pass filters (at first stage 610) the input signal frame. The transient detection process 600 uses three filters with pass bands in different audio ranges, i.e., low, middle and high-pass ranges. The filters may be elliptic filters, such as may be designed using a standard filter design tool (e.g., MATLAB), although other filter shapes alternatively can be used. The squared output of the filters represents the power of the input signal in the respective audio spectrum range at each sample. The low-pass, mid-pass and high-pass power outputs are denoted herein as $P_l(n)$, $P_m(n)$, and $P_h(n)$, where n is the sample number within the frame.

Next (at stage 620), the transient detection process 600 further low-pass filters (i.e., smoothes) the power outputs of the band-pass filter stage for each sample. The transient detection process 600 performs low-pass filtering by computing the following sums (denoted $Q_l(n)$, $Q_m(n)$ and $Q_h(n)$) of the low-pass, mid-pass and high-pass filtered power outputs at each sample n, as shown in the following equations:

$$Q_l(n) = \sum_{i=0}^{t} P_l(n-s+i) \tag{3}$$

$$Q_m(n) = \sum_{i=0}^{t} P_m(n-s+i) \tag{4}$$

$$Q_h(n) = \sum_{i=0}^{t} P_h(n-s+i) \tag{5}$$

where s and t are predefined constants and (t>s). Examples of suitable values for the constants are t=256 and s=288.

The transient detection process 600 then (at stage 630) calculates the local power at each sample by again summing the power outputs of the three bands over a smaller interval centered at each sample, as shown by the following equations:

$$S_l(n) = \sum_{i=0}^{v} P_l(n-u+i) \tag{6}$$

$$S_m(n) = \sum_{i=0}^{v} P_m(n-u+i) \tag{7}$$

$$S_h(n) = \sum_{i=0}^{v} P_h(n-u+i) \tag{8}$$

where u and v are predefined constants smaller than t and s. Examples of suitable values of the constants are u=32 and v=32.

At stage 640, the transient detection process 600 compares the local power at each sample to the low-pass filter power output, by calculating the ratios shown in the following equations:

$$R_l(n) = \frac{S_l(n)}{Q_l(n)} \tag{9}$$

$$R_m(n) = \frac{S_m(n)}{Q_m(n)} \tag{10}$$

$$R_h(n) = \frac{S_h(n)}{Q_h(n)} \tag{11}$$

Finally, at decision stage 650 and 660, the transient detection process 600 determines that a transient exists if the ratio calculated at stage 640 exceeds predetermined thresholds, $T_l$, $T_m$, and $T_h$ for the respective bands. In other words, if any of $R_l(n)>T_l$, $R_l(n)>T_l$, or $R_l(n)>T_l$, then the sample location n is marked as a transient location. An example of suitable threshold values is in the range of 10 to 40.

B. Open-Loop Window Configuration

FIG. 8 shows an open-loop window configuration process 800, which is used in the window configuration component 530 to perform its first pass window configuration. The open-loop window configuration process 800 configures window sizes for transform coding by the encoding component 540 based on information of transient locations detected via the transient detection process 600 by the transient detection component 520. In the illustrated process, the window configuration component 530 selects from a number of predefined sizes, which may include a smallest size, largest size, and one or more intermediate sizes.

As indicated at step 810 in the window configuration process 800, the process 800 determines if any transients were detected in the frame. If so, the window configuration process places windows of the smallest size over transient-containing regions of the frame (as indicated at 820), such that the transients are completely encompassed by one or more smallest size windows. Then (at 830), the process 800 fills gaps before and after the smallest size windows with one or more transition windows. The transition windows may have transform filter shapes and sizes determined according to the design method discussed in Shlien (cited above).

If no transients are detected in a frame, the window configuration process 800 configures the frame to contain a largest size window (as indicated at 840). The process 800 continues on a frame-by-frame basis as indicated at step 850.

Figure 7:
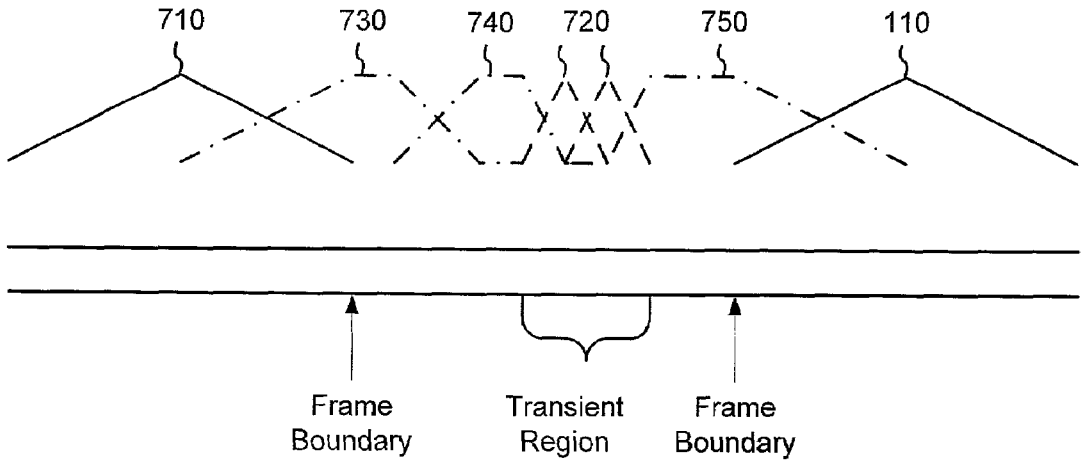
FIG. 7 is a graph of an example configuration of windows produced in the transform coder of FIG. 5.

FIG. 7 shows an example window configuration produced via the process 800. First, since no transient is detected in the prior frame, the process 800 places a largest size window 710 in that frame. The process 800 then places smallest size windows 720 to completely encompass transients detected in a transient region. The process 800 next fills a gap between the window 710 and windows 720 with intermediate size transition windows 730 and 740, and also fills a gap with the next frame window with intermediate size transition window 750.

The open-loop window configuration process 800 has the advantage that the smallest size windows are placed over the transient region, as compared to filling a full frame. The window configuration produced via the open-loop window configuration process 800 typically is adjusted in the second pass, closed loop window configuration, described more fully below, less than 10% of the time. Accordingly, the open-loop window configuration process can be considered to yield a good selection of window size about 90% of the time.

C. Quality Measurement Feedback And Closed-Loop Window Configuration

As discussed above, the quality measurement component 550 analyzes the achieved quality of audio information that is transform coded using the first-pass window configuration, and feeds back the quality measurements to the window configuration component for use in adjusting window sizes in a closed-loop, second pass window configuration process. In this second pass, the window configuration component 550 may take two actions depending on the achieved quality of the signal when transform coded using the first-pass window configuration. First, when the quantization noise is not acceptable, the window configuration component 550 trades the time resolution for better quantization by increasing the smallest window size. Further, when pre-echo is detected, the window configuration component splits the corresponding windows to increase time resolution, provided there are sufficient spare bits to meet bit rate constraints.

Figure 11:
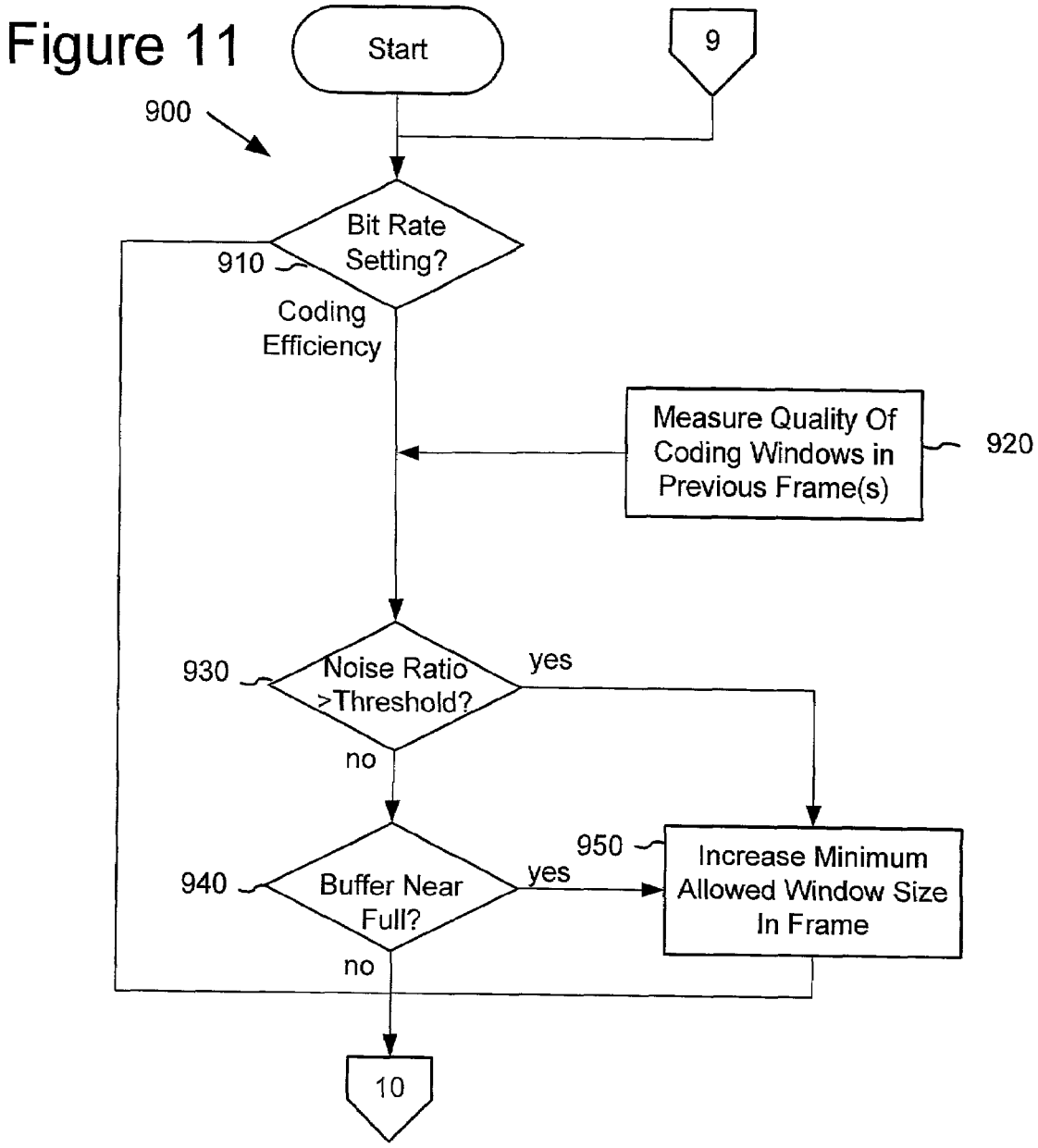
FIG. 11 is a flow chart of an alternative process to that depicted in the flow chart of FIG. 9.

More specifically, FIGS. 9 and 10 show a quality measurement and closed-loop window configuration process 900 for the second pass window configuration. FIG. 11 shows an alternative implementation of the process 900. As indicated at decisions 910 and 1010, the bit rate settings of the transform coder 500 (FIG. 5) determine whether the process 900 takes the actions depicted for processing loops 920-950 and 1020-1040, respectively. More particularly, when the bit rate setting emphasizes coding efficiency (at 910), the window configuration process 900 performs processing loop 920-950. When the rate setting is for high quality (at 1010), the window configuration process 900 performs processing in loop 1020-1040. These rate setting classes need not be mutually exclusive. In other words, there may be some rate settings in some transform coders that call for a balance of both coding efficiency and quality, such that both processing loops 920-950 and 1020-1040 are performed.

At a first processing step 920 in the first processing loop 920-950, the window configuration process 900 measures the achieved quality of the transform coded signal. In one implementation, the process 900 measures the achieved Noise-To-Excitation Ratio (NER) for each coding window. The NER of the coding window of the reconstructed, transform coded signal can be calculated as described the Perceptual Audio Quality Measurement Patent Application, which is incorporated by reference herein above. Alternatively, other quality measures applicable to assessing acceptability or perceptibility of quantization noise can be used, such as noise-to-mask ration described or referenced in "Method for objective measurements of perceived audio quality," International Telecommunication Union-Recommendation Broadcasting Service (Sound) Series (ITU-R BS) 1387 (1998).

Next (at 930), the window configuration process 900 compares the quality measurement to a threshold. If the quantization noise is not acceptable, the window configuration process 900 (at 950) increases the minimum allowed window size for the frame. As an example, in one implementation, the window configuration process 900 increases the minimally allowed window size for the frame by a factor of 2 if the NER of a coding window in the frame exceeds 0.5. If the NER is greater than 1.0, the minimum allowed window size is increased by 4 times. The acceptable quantization noise threshold and the increase in minimum allowed window size are parameters that can be varied in alternative implementations.

As indicated at decision 940, the window configuration process 900 also can increase the window size when the quantization noise is acceptable, but the rate control buffer of the transform coder is nearly full (e.g., 95% or other like amount depending on size of buffer, variance in bit rate, and other factors).

In the alternative implementation of the process 900 shown in FIG. 11, the window configuration process 900 at processing step 920 uses a delayed quality measurement. As examples, the quality of coding of the preceding frame or average quality of previous few frames could be used to determine the minimum allowed window size for the current frame. In one implementation, the final NER obtained at the preceding frame is used to determine the minimum window size (at 950) used in the open-loop window configuration process 800. Such use of a delayed quality measurement reduces the implementation complexity, albeit with some sacrifice in accuracy.

In the second processing loop 1020-1040, the window configuration process 900 also measures to detect pre-echo in the frame. For pre-echo detection, the process 900 divides the frame of the reconstructed, transform coded signal into a set of very small windows (smaller than the smallest coding window), and calculates the quality measure (e.g., the NMR or NER) for each of the very small windows. This produces a quality measure vector (e.g., a vector of NMR or NER values). The process 900 also calculates a global achieved quality measure for the frame (e.g., the NMR or NER of the frame). The process 900 determines that pre-echo exists if any component of the vector is significantly higher (e.g., by a threshold factor) than the achieved global quality measure for the frame. Suitable threshold factor is in the range 4 to 10. Alternative implementations can use other values for the threshold.

In the case where pre-echo is detected and there is sufficient spare coding capacity (e.g., rate control buffer not full or nearly full), the window configuration process 900 (at 1040) adjusts the window configuration in the frame to further reduce the window size. In one implementation, the process 900 decomposes the frame into a series of smallest size windows (e.g., the size of window 720 of FIG. 7). Alternatively, the process 900 locally reduces the size of the first-pass coding windows in which pre-echo is detected, rather than reducing all windows in the frame to the smallest size.

As indicated at 1050, the window configuration process 900 then continues on a frame-by-frame basis. However, alternative implementations need not perform the window configuration on a frame basis.

The described closed-loop window configuration process has the additional advantage over the open-loop configuration of offering further assurance against pre-echo, and also provides a mechanism for graceful degradation of quality to meet bit rate constraints. The combination of the open-loop and closed-loop processes in a two-pass window configuration thus provides a balance of maximizing coding efficiency while achieving sufficient time resolution to avoid pre-echo.

Having described and illustrated the principles of our invention with reference to an illustrative embodiment, it will be recognized that the illustrative embodiment can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the illustrative embodiment shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. A transform coder computer system for audio signal processing comprising:

a transient detection component stored in computer system memory operating to process samples of an input signal to identify locations of transients in the input signal;

an open-loop window configuration component stored in computer system memory operating in response to the identified transient location to configure a first configuration of sizes of a plurality of transform input windows over the input signal selected from at least a first window size, a second window size, and a third window size, so as to place one or more windows of the first window size to encompass a region of the input signal having at least one identified transient location and place windows of the second size in areas of the input signal having no identified transient locations;

an encoding component stored in computer system memory for transform coding the input signal according to the first configuration of transform input window sizes, and for decoding to produce a reconstructed signal;

a quality measurement component stored in computer system memory operating to measure achieved quality of the reconstructed signal; and a closed-loop window configuration component stored in computer system memory operating in response to the achieved quality measurement to adjust sizes of the transform input windows in the first configuration according to the achieved quality measurement to produce a second configuration of transform input windows for use in transform coding the input signal.

2. The transform coder of claim 1 wherein the open-loop window configuration component is further operative to place at least one transform input window of the third window size between the transform input windows of the first window size and those of the second size.

3. The transform coder of claim 1 wherein the closed-loop window configuration component operates to adjust sizes of the transform input windows in a current portion of the input signal according to the achieved quality measurement of a preceding portion of the reconstructed signal.

4. The transform coder of claim 1 wherein:

the quality measurement component further operates to measure achieved perceptual quantization noise of the reconstructed signal for at least some of the transform input windows in the first configuration; and the closed-loop window configuration component further operates to increase a minimum permitted window size of transform input windows for at least a portion of the input signal where the measure of achieved perceptual quantization noise exceeds an acceptable threshold.

5. The transform coder of claim 4 wherein:

the closed-loop window configuration component also operates to increase a minimum permitted window size of transform input windows for at least a portion of the input signal when utilization of a rate control buffer exceeds a fullness threshold.

6. The transform coder of claim 1 wherein:

the quality measurement component further operates to detect pre-echo in the reconstructed signal; and the closed-loop window configuration component further operates to decrease window size of at least one transform input window in at least a portion of the input signal where pre-echo is detected.

7. The transform coder of claim 6 wherein said decreasing the window size comprises decomposing a frame in which pre-echo is detected into transform input windows of the first window size; the first window size being smaller than the second window size and the first window size being smaller than the third window size.

8. The transform coder of claim 6 wherein said decreasing the window size comprises decomposing a transform input window in the first configuration in which pre-echo is detected into transform input windows of the first window size; the first window size being smaller than the second window size and the first window size being smaller than the third window size.

9. In a computer-enabled transform coder, a method of adaptively selecting transform window size for signal processing, the method comprising:

detecting locations of transients in an input signal;

for a frame of the input signal in which no transient location is detected, configuring size of a transform window to be a first window size;

for a frame of the input signal in which at least one transient location is detected, configuring sizes of a plurality of transform windows in the frame to comprise a consecutive set of at least one second-size window substantially encompassing the transient locations in the frame and at least one third-size window before the transient, where the second window size is smaller than the first window size and where the third window size is intermediate to the first and second window sizes;

transform encoding the input signal according to a first transform window configuration including the configured sizes of transform windows;

measuring achieved perceptual quality of the transform-encoded signal;

storing the measured perceptual quality in memory associated with the transform coder;

retrieving the measured perceptual quality from memory;

using the retrieved measured perceptual quality, re-configuring the size of at least some of the transform windows configured in the first transform window configuration according to the measured perceptual quality to produce a second transform window configuration; and transform encoding the input signal according to the second transform window configuration.

10. In a computer-enabled transform coder, a method of adaptively selecting transform window size for audio signal processing, the method comprising:

detecting locations of transients in an input signal;

for a frame of the input signal in which no transient location is detected, configuring size of a transform window to be a first window size;

for a frame of the input signal in which at least one transient location is detected, configuring sizes of a plurality of transform windows in the frame to comprise a consecutive set of at least one second-size window substantially encompassing the transient locations in the frame and at least one third-size window before the transient, where the second window size is smaller than the first window size and where the third window size is intermediate to the first and second window sizes;

transform encoding the input signal according to a first transform window configuration including the configured sizes of transform windows;

measuring achieved perceptual quality of the transform-encoded signal for at least some of the configured transform windows;

storing the measured perceptual quality in memory associated with the transform coder;

retrieving the measured perceptual quality from memory;

using the retrieved measured perceptual quality, increasing sizes of at least some transform windows in the first transform window configuration where the achieved perceptual quality of the transform-encoded signal exceeds an acceptable level to produce a second transform window configuration;

transform encoding the input signal according to the second transform window configuration.

11. The method of claim 10 further comprising:

increasing sizes of at least some transform windows in the first transform window configuration to produce the second transform window configuration when utilization of a rate control buffer exceeds a fullness threshold.

12. In a computer-enabled transform coder, a method of adaptively selecting transform window size for audio signal processing, the method comprising:

detecting locations of transients in an input signal;

for a frame of the input signal in which no transient location is detected, configuring size of a transform window to be a first window size;

for a frame of the input signal in which at least one transient location is detected, configuring sizes of a plurality of transform windows in the frame to comprise a consecutive set of at least one second-size window substantially encompassing the transient locations in the frame and at least one third-size window before the transient, where the second window size is smaller than the first window size and where the third window size is intermediate to the first and second window sizes;

transform encoding the input signal according to a first transform window configuration including the configured sizes of transform windows;

increasing sizes of at least some transform windows in the first transform window configuration to produce a second transform window configuration when utilization of a rate control buffer exceeds a fullness threshold;

storing the second transform window configuration in memory associated with the transform coder;

retrieving the second transform window configuration from memory; and using the retrieved second transform window configuration, transform encoding the input signal according to the second transform window configuration.

13. In a computer-enabled transform coder, a method of adaptively selecting transform window size for audio signal processing, the method comprising:

detecting locations of transients in an input signal;

for a frame of the input signal in which no transient location is detected, configuring size of a transform window to be a first window size;

for a frame of the input signal in which at least one transient location is detected, configuring sizes of a plurality of transform windows in the frame to comprise a consecutive set of at least one second-size window substantially encompassing the transient locations in the frame and at least one third-size window before the transient, where the second window size is smaller than the first window size and where the third window size is intermediate to the first and second window sizes;

transform encoding the input signal according to a first transform window configuration including the configured sizes of transform windows;

measuring achieved perceptual quality of the transform-encoded signal for at least some of the configured transform windows;

storing the measured perceptual quality in memory associated with the transform coder;

retrieving the measured perceptual quality from memory;

using the retrieved measured perceptual quality, increasing sizes of transform windows in a frame in the first transform window configuration to an increased minimum size greater than the second window size where the achieved perceptual quality of the transform-encoded signal in the frame exceeds an acceptable level to produce a second transform window configuration;

transform encoding the input signal according to the second transform window configuration.

14. In a computer-enabled transform coder, a method of adaptively selecting transform window size for audio signal processing, the method comprising:

detecting locations of transients in an input signal;

for a frame of the input signal in which no transient location is detected, configuring size of a transform window to be a first window size;

for a frame of the input signal in which at least one transient location is detected, configuring sizes of a plurality of transform windows in the frame to comprise a consecutive set of at least one second-size window substantially encompassing the transient locations in the frame and at least one third-size window before the transient, where the second window size is smaller than the first window size and where the third window size is intermediate to the first and second window sizes;

transform encoding the input signal according to a first transform window configuration including the configured sizes of transform windows;

detecting pre-echo in the transform-encoded signal;

decreasing sizes of at least some transform windows in the first transform window configuration in a portion of the transform-encoded signal where pre-echo is detected to produce a second transform window configuration;

storing the second transform window configuration in memory associated with the transform coder;

retrieving the second transform window configuration from memory;

using the second transform window configuration, transform encoding the input signal according to the second transform window configuration.

15. The method of claim 14 wherein measuring pre-echo comprises:

measuring a vector of achieved perceptual quality of a plurality of segments of the transform-encoded signal, the segments being smaller than the second window size;

measuring a global achieved perceptual quality of at least a portion of the transform-encoded signal; and determining that pre-echo exists at location of the input signal corresponding to components of the achieved perceptual quality in the vector that exceed a significancy multiple of the global achieved perceptual quality.

16. The method of claim 14 wherein decreasing sizes of at least some transform windows in the first window configuration comprises:

decomposing configured transform windows in the first window configuration that form a frame in which pre-echo is detected into minimum size transform windows to produce the second transform window configuration.

17. The method of claim 14 wherein decreasing sizes of at least some transform windows in the first window configuration comprises:

decomposing configured transform windows in the first window configuration in which pre-echo is detected into smaller size windows to produce the second transform window configuration.

18. In a computer-enabled transform coder, a method of adaptively selecting transform window size for audio signal processing, the method comprising:

detecting locations of transients in an input signal;

for a frame of the input signal in which no transient location is detected, configuring size of a transform window to be a first window size;

for a frame of the input signal in which at least one transient location is detected, configuring sizes of a plurality of transform windows in the frame to comprise a consecutive set of at least one second-size window substantially encompassing the transient locations in the frame, where the second window size is smaller than the first window size;

transform encoding the input signal according to a first transform window configuration including the configured sizes of transform windows;

measuring achieved perceptual quality of the transform-encoded signal;

storing the measured perceptual quality in memory associated with the transform coder;

retrieving the measured perceptual quality from memory;

using the retrieved measured perceptual quality, re-configuring the size of at least some of the transform windows configured in the first transform window configuration according to the measured perceptual quality to produce a second transform window configuration; and transform encoding the input signal according to the second transform window configuration.

19. The method of claim 18 wherein said re-configuring the size of at least some of the transform windows comprises:

increasing sizes of at least some transform windows in the first transform window configuration where the achieved perceptual quality of the transform-encoded signal exceeds an acceptable level to produce the second transform window configuration.

20. The method of claim 18 wherein said re-configuring the size of at least some of the transform windows comprises:

increasing sizes of at least some transform windows in the first transform window configuration to produce the second transform window configuration when utilization of a rate control buffer exceeds a fullness threshold.

21. The method of claim 18 wherein said re-configuring the size of at least some of the transform windows comprises:

increasing sizes of transform windows in a frame in the first transform window configuration to an increased minimum size greater than the second window size where the achieved perceptual quality of the transform-encoded signal in the frame exceeds an acceptable level to produce the second transform window configuration.

22. The method of claim 18 further comprising:

detecting pre-echo based on said measuring achieved perceptual quality of the transform-encoded signal; and decreasing sizes of at least some transform windows in the first transform window configuration in a portion of the transform-encoded signal where pre-echo is detected to produce the second transform window configuration.

23. The method of claim 22 wherein measuring pre-echo comprises:

measuring a vector of achieved perceptual quality of a plurality of segments of the transform-encoded signal, the segments being smaller than the second window size;

measuring a global achieved perceptual quality of at least a portion of the transform-encoded signal; and determining that pre-echo exists at location of the input signal corresponding to components of the achieved perceptual quality in the vector that exceed a significancy multiple of the global achieved perceptual quality.

24. The method of claim 22 wherein decreasing sizes of at least some transform windows in the first window configuration comprises:

decomposing configured transform windows in the first window configuration that form a frame in which pre-echo is detected into minimum size transform windows to produce the second transform window configuration.

25. The method of claim 22 wherein decreasing sizes of at least some transform windows in the first window configuration comprises:

decomposing configured transform windows in the first window configuration in which pre-echo is detected into smaller size windows to produce the second transform window configuration.

26. In a computer-enabled transform coder, a method of adaptively selecting transform window size for audio signal processing, the method comprising:

detecting locations of transients in a current frame of an input signal;

measuring achieved perceptual quality of at least one prior transform-encoded frame of the input signal;

storing the measured achieved perceptual quality in memory associated with the computer-enabled transform coder;

using the stored measured achieved perceptual quality, determining a minimal window size for the current frame based on the measured achieved perceptual quality of the at least one prior transform-encoded frame;

for a first case in which no transient location is detected in the current frame, configuring size of a transform window to be a first window size;

for a second case in which at least one transient location is detected in the current frame of the input signal, configuring sizes of a plurality of transform windows in the frame to comprise a consecutive set of at least one second-size window substantially encompassing the transient locations in the frame, where the second window size is the minimal window size for the current frame; and transform encoding the current frame of the input signal according to the configured sizes of transform windows.

27. The method of claim 26 wherein said determining the minimal window size comprises:

increasing the minimal window size for the current frame if the achieved perceptual quality of the at least one prior transform-encoded frame of the input signal exceeds an acceptable level.

28. The method of claim 26 wherein said determining the minimal window size comprises:

increasing the minimal window size for the current frame if utilization of a rate control buffer exceeds a fullness threshold.

29. The method of claim 26 further comprising:

detecting pre-echo; and decreasing sizes of at least some transform windows where pre-echo is detected.

30. The method of claim 29 wherein measuring pre-echo comprises:

measuring a vector of achieved perceptual quality of a plurality of segments of the input signal, the segments being smaller than the second window size;

measuring a global achieved perceptual quality of the at least one prior transform-encoded frame; and determining that pre-echo exists at location of the input signal corresponding to components of the achieved perceptual quality in the vector that exceed a significancy multiple of the global achieved perceptual quality.

31. The method of claim 29 wherein the decreasing sizes comprises:

if pre-echo is detected, decomposing all configured transform windows in the current frame to the minimal window size.

32. The method of claim 29 wherein the decreasing sizes comprises:

decomposing only those configured transform windows in the current frame in which pre-echo is detected to the minimal window size.

33. A computer readable medium having instructions that when executed on an audio processing device perform a method of adaptively selecting transform window size for audio signal processing, the method comprising:

detecting locations of transients in an input signal;

for a frame of the input signal in which no transient location is detected, configuring size of a transform window to be a first window size;

for a frame of the input signal in which at least one transient location is detected, configuring sizes of a plurality of transform windows in the frame to comprise a consecutive set of at least one second-size window substantially encompassing the transient locations in the frame, where the second window size is smaller than the first window size;

transform encoding the input signal according to a first transform window configuration including the configured sizes of transform windows, measuring achieved perceptual quality of the transform-encoded signal;

re-configuring the size of at least some of the transform windows configured in the first transform window configuration according to the measured perceptual quality to produce a second transform window configuration; and transform encoding the input signal according to the second transform window configuration.

34. The computer readable medium of claim 33 wherein said re-configuring the size of at least some of the transform windows comprises:

increasing sizes of at least some transform windows in the first transform window configuration where the achieved perceptual quality of the transform-encoded signal exceeds an acceptable level to produce the second transform window configuration.

35. The computer readable medium of claim 33 wherein said re-configuring the size of at least some of the transform windows comprises:

increasing sizes of at least some transform windows in the first transform window configuration to produce the second transform window configuration when utilization of a rate control buffer exceeds a fullness threshold.

36. The computer readable medium of claim 33 wherein said re-configuring the size of at least some of the transform windows comprises:

increasing sizes of transform windows in a frame in the first transform window configuration to an increased minimum size greater than the second window size where the achieved perceptual quality of the transform-encoded signal in the frame exceeds an acceptable level to produce the second transform window configuration.

37. The computer readable medium of claim 33 wherein the method further comprises:

detecting pre-echo based on said measuring achieved perceptual quality of the transform-encoded signal; and decreasing sizes of at least some transform windows in the first transform window configuration in a portion of the transform-encoded signal where pre-echo is detected to produce the second transform window configuration.

38. The computer readable medium of claim 37 wherein measuring pre-echo comprises:

measuring a vector of achieved perceptual quality of a plurality of segments of the transform-encoded signal, the segments being smaller than the second window size;

measuring a global achieved perceptual quality of at least a portion of the transform-encoded signal; and determining that pre-echo exists at location of the input signal corresponding to components of the achieved perceptual quality in the vector that exceed a significancy multiple of the global achieved perceptual quality.

39. The computer readable medium of claim 37 wherein decreasing sizes of at least some transform windows in the first window configuration comprises:

decomposing configured transform windows in the first window configuration that form a frame in which pre-echo is detected into minimum size transform windows to produce the second transform window configuration.

40. The computer readable medium of claim 37 wherein decreasing sizes of at least some transform windows in the first window configuration comprises:

decomposing configured transform windows in the first window configuration in which pre-echo is detected into smaller size windows to produce the second transform window configuration.

* * * * *